US009123312B2

(12) United States Patent
McCabe

(10) Patent No.: US 9,123,312 B2
(45) Date of Patent: Sep. 1, 2015

(54) TUNING MECHANISMS

(76) Inventor: Geoffrey Lee McCabe, Hollywood, CA (US)

( * ) Notice: Subject to any disclaimer, the term of this patent is extended or adjusted under 35 U.S.C. 154(b) by 532 days.

(21) Appl. No.: 13/402,825

(22) Filed: Feb. 22, 2012

(65) Prior Publication Data

US 2013/0186255 A1 Jul. 25, 2013

Related U.S. Application Data

(60) Provisional application No. 61/588,172, filed on Jan. 19, 2012.

(51) Int. Cl.
*G10D 3/00* (2006.01)
*G10D 3/14* (2006.01)

(52) U.S. Cl.
CPC ..... *G10D 3/146* (2013.01)

(58) Field of Classification Search
CPC ..... G10D 3/146
USPC ..... 84/313
See application file for complete search history.

(56) References Cited

U.S. PATENT DOCUMENTS 1,475,345 A 11/1923 Lambert et al.
2,191,776 A 2/1940 Schreiber
2,976,755 A 3/1961 Fender
3,313,196 A 4/1967 Mari
3,407,696 A 10/1968 Smith et al.
3,599,524 A 8/1971 Jones
3,678,795 A 7/1972 Fullerton
3,763,736 A 10/1973 Williams
3,911,777 A 10/1975 Rendell
3,911,778 A 10/1975 Martin
3,915,049 A 10/1975 Bean
4,027,570 A 6/1977 Rendell et al.
4,037,506 A 7/1977 How
4,111,093 A 9/1978 Field et al.
4,135,426 A 1/1979 Rickard
4,142,435 A 3/1979 Pozar
4,171,661 A 10/1979 Rose
4,201,108 A 5/1980 Bunker
4,206,679 A 6/1980 Wilson
4,208,941 A 6/1980 Wechter
4,241,637 A 12/1980 Brent
4,283,982 A 8/1981 Armstrong
4,304,163 A 12/1981 Siminoff
4,348,934 A 9/1982 Ogata
4,366,740 A 1/1983 Tripp
4,377,101 A 3/1983 Santucci (Continued)

*Primary Examiner* — Jianchun Qin

(57) ABSTRACT

The improved tuning mechanisms include a novel string clamp comprising a lever based clamping element oblique to the string path that utilizes an enlarged radiused underside to provide a variable clamping point to address various diameters of strings which can be integrated into either a fine-tuner or Macro-tuner arrangements; further, there, is, in addition to an improved Global-tuner, a fixed dimension multi-tier insert plate for a tremolo base plate, provided in differing sizes, to support bridge elements in a radii that matches various fingerboard radii, and improvements directed towards integrated riser posts for bearing arrangements on the pivot axis of a fulcrum tremolo provide a slotted axel recess and a separate threaded outer sleeve-like portion to allow alignment to the tremolo's bearing axis regardless of the position of riser post within body for adjustably mounting the fulcrum tremolo to the instrument, which, in the preferred embodiment, all work cooperatively together.

22 Claims, 6 Drawing Sheets

(56) References Cited

U.S. PATENT DOCUMENTS

| | | | | |
|---|---|---|---|---|
| 4,389,917 | A | 6/1983 | Tiebout, III | |
| 4,425,831 | A | 1/1984 | Lipman | |
| 4,433,603 | A | 2/1984 | Siminoff | |
| 4,457,201 | A | 7/1984 | Storey | |
| 4,462,295 | A | 7/1984 | Hundley | |
| 4,472,994 | A | 9/1984 | Armstrong | |
| 4,475,432 | A | 10/1984 | Stroh | |
| 4,497,236 | A | 2/1985 | Rose | |
| 4,522,101 | A | 6/1985 | Peavey et al. | |
| 4,549,461 | A | 10/1985 | Rose | |
| 4,555,970 | A | 12/1985 | Rose | |
| 4,573,391 | A | 3/1986 | White | |
| 4,608,904 | A | 9/1986 | Steinberger | |
| 4,608,905 | A | 9/1986 | Takabayashi | |
| 4,608,906 | A | 9/1986 | Takabayashi | |
| 4,632,005 | A | 12/1986 | Steinberger | |
| 4,638,708 | A | 1/1987 | Kamal | |
| 4,638,711 | A | 1/1987 | Stroh | |
| 4,648,304 | A | 3/1987 | Hoshino et al. | |
| 4,656,915 | A | 4/1987 | Osuga | |
| 4,672,877 | A | 6/1987 | Hoshino et al. | |
| 4,674,389 | A | 6/1987 | Fender | |
| 4,677,891 | A | 7/1987 | Gressett, Jr. et al. | |
| 4,681,011 | A | 7/1987 | Hoshino | |
| 4,690,027 | A | 9/1987 | Ido | |
| 4,696,218 | A | 9/1987 | Hoshino et al. | |
| 4,712,463 | A | 12/1987 | Kubicki et al. | |
| 4,724,737 | A | 2/1988 | Fender | |
| 4,768,415 | A | 9/1988 | Gressett, Jr. et al. | |
| 4,779,506 | A | 10/1988 | Takeuti | |
| 4,793,236 | A | 12/1988 | McGuire et al. | |
| 4,803,906 | A | 2/1989 | Fender | |
| 4,840,102 | A | 6/1989 | Pittman | |
| 4,854,210 | A | 8/1989 | Palazzolo | |
| 4,882,967 | A | 11/1989 | Rose | |
| 4,905,563 | A | 3/1990 | Davies | |
| 4,939,970 | A | 7/1990 | Hoshino et al. | |
| 4,945,801 | A | 8/1990 | Stroh et al. | |
| 4,967,631 | A | 11/1990 | Rose | |
| 4,982,640 | A | 1/1991 | Buscarino | |
| 5,012,716 | A | 5/1991 | Pagelli | |
| 5,014,588 | A | 5/1991 | Omata et al. | |
| 5,033,353 | A | 7/1991 | Fala et al. | |
| 5,052,269 | A | 10/1991 | Young, Jr. | |
| 5,072,646 | A | 12/1991 | Valkama | |
| D324,693 | S | 3/1992 | Rose | |
| 5,097,737 | A | 3/1992 | Uhrig | |
| 5,123,326 | A | 6/1992 | Clevinger | |
| 5,125,311 | A | 6/1992 | Boulanger et al. | |
| 5,136,918 | A | 8/1992 | Riboloff | |
| 5,140,884 | A | 8/1992 | Bowden | |
| 5,171,927 | A | 12/1992 | Kubicki et al. | |
| 5,191,159 | A | 3/1993 | Jordan | |
| 5,198,601 | A | 3/1993 | McCabe | |
| 5,227,571 | A | 7/1993 | Cipriani | |
| 5,265,512 | A | 11/1993 | Kubicki et al. | |
| 5,277,095 | A | 1/1994 | Steinberger | |
| 5,295,427 | A | 3/1994 | Johnsen et al. | |
| 5,337,643 | A | 8/1994 | Cantrell | |
| 5,343,793 | A | 9/1994 | Pattie | |
| 5,347,904 | A | 9/1994 | Lawrence | |
| 5,347,905 | A | 9/1994 | Cipriani | |
| 5,353,672 | A | 10/1994 | Stewart | |
| 5,355,759 | A | 10/1994 | Hoshino | |
| 5,361,667 | A | 11/1994 | Pritchard | |
| 5,372,057 | A | 12/1994 | Hart | |
| 5,390,578 | A | 2/1995 | Raymer | |
| 5,398,581 | A | 3/1995 | Castillo | |
| 5,410,936 | A | 5/1995 | Ellsworth et al. | |
| 5,413,019 | A | 5/1995 | Blanda, Jr. | |
| 5,421,233 | A | 6/1995 | Bunker | |
| 5,431,079 | A | 7/1995 | Bunker | |
| 5,438,901 | A | 8/1995 | Sperzel | |
| 5,452,637 | A | 9/1995 | DeCola | |
| 5,458,035 | A | 10/1995 | Okamura | |
| 5,477,764 | A | 12/1995 | Carrico | |
| 5,519,165 | A | 5/1996 | Gregory | |
| 5,522,299 | A | 6/1996 | Rose | |
| 5,537,907 | A | 7/1996 | Rose | |
| 5,539,143 | A | 7/1996 | Rose | |
| 5,549,027 | A | 8/1996 | Steinberger et al. | |
| 5,567,903 | A | 10/1996 | Coopersmith et al. | |
| 5,589,653 | A | 12/1996 | Rose | |
| 5,600,078 | A | 2/1997 | Edwards | |
| 5,614,688 | A | 3/1997 | Donnell | |
| 5,631,432 | A | 5/1997 | Muncy | |
| 5,637,818 | A | 6/1997 | Fishman et al. | |
| 5,637,823 | A | 6/1997 | Dodge | |
| 5,661,252 | A | 8/1997 | Krawczak | |
| 5,672,835 | A | 9/1997 | Doughty | |
| 5,679,910 | A | 10/1997 | Steinberger et al. | |
| 5,684,256 | A | 11/1997 | Rose | |
| 5,689,075 | A | 11/1997 | Rose | |
| 5,696,335 | A | 12/1997 | Rose | |
| 5,700,965 | A | 12/1997 | Rose | |
| 5,705,760 | A | 1/1998 | Rose | |
| 5,717,150 | A | 2/1998 | Rose | |
| 5,739,444 | A | 4/1998 | Borisoff | |
| 5,945,615 | A | 8/1999 | Rose | |
| 5,965,831 | A | 10/1999 | McCabe | |
| 5,986,191 | A | 11/1999 | McCabe | |
| 6,046,393 | A | 4/2000 | Rose | |
| 6,046,397 | A | 4/2000 | Rose | |
| 6,051,773 | A | 4/2000 | Rose | |
| 6,111,176 | A | 8/2000 | Rose | |
| 6,137,039 | A | 10/2000 | Rose | |
| 6,175,066 | B1 | 1/2001 | McCabe | |
| 6,194,645 | B1 | 2/2001 | Rose | |
| 6,198,030 | B1 | 3/2001 | Rose | |
| 6,563,034 | B2 | 5/2003 | McCabe | |
| 6,710,235 | B2 * | 3/2004 | Hirayama | 84/313 |
| 7,470,841 | B1 | 12/2008 | McCabe | |
| 8,536,431 | B1 * | 9/2013 | McCabe et al. | 84/313 |
| 2005/0051020 | A1 * | 3/2005 | Cenker | 84/458 |
| 2010/0037746 | A1 * | 2/2010 | Medas | 84/298 |
| 2010/0175534 | A1 * | 7/2010 | McCabe et al. | 84/313 |

* cited by examiner

Fig. 3A
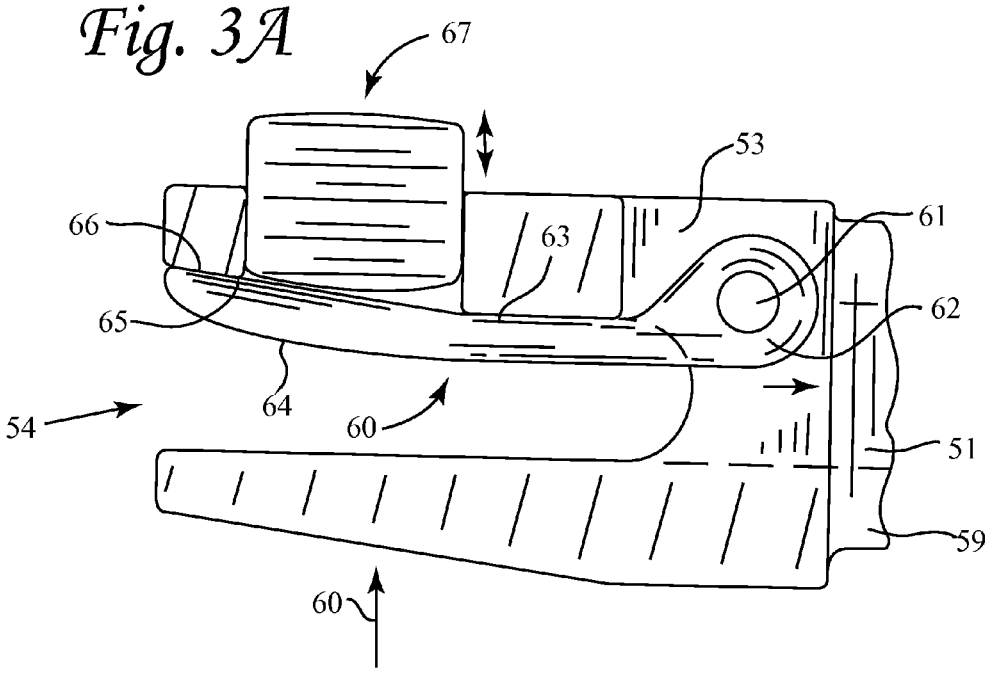
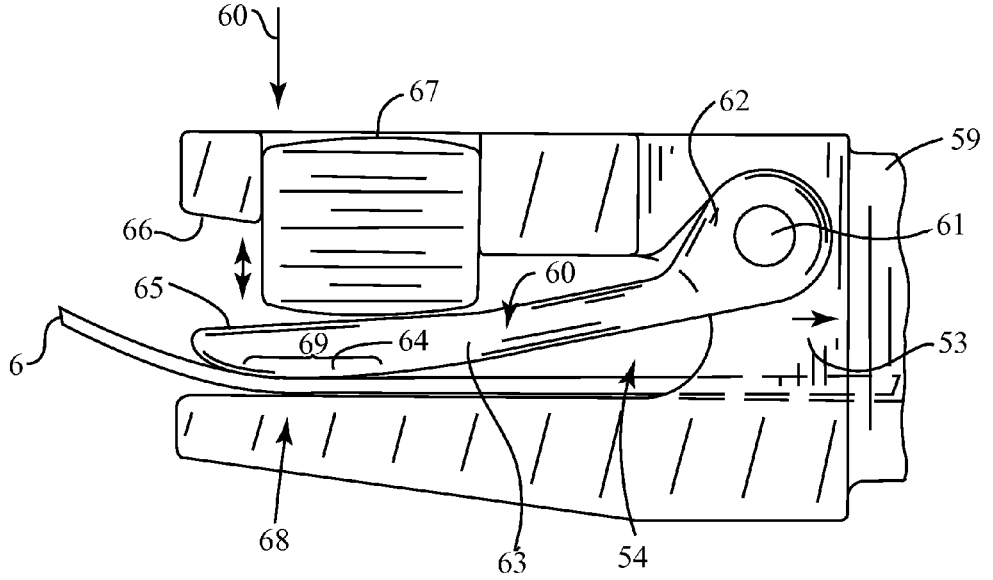
Fig. 3B

TUNING MECHANISMS

I, Geoffrey McCabe, claim priority from the above referenced USPTO Provisional Application No. 61/588,172 filed Jan. 19, 2012 for Improved Tuning Mechanisms directed for use with stringed musical instruments.

BACKGROUND OF THE INVENTION

In a stringed musical instrument, such as a guitar, the strings, placed under tension, extend unsupported between a first critical point usually formed by the nut positioned where the neck joins the head and a second critical point usually formed by a clearly defined point on the bridge positioned on the body. The strings are secured or fixed at one end on the body of the instrument to what is traditionally known as the tailpiece, strung over the bridge and extended past the nut at the transition from the neck instrument to the head, and, for conventional instruments, secured at the other end to the tuning pegs where an untensioned string is tensioned and adjusted to a tuned pitched condition, proper playing pitch for play, or, simply, tuned condition; sometimes a nut arrangement is provided for a headless or tuning peg-less design. The neck further comprises a fingerboard or fret board that a player presses the strings against to play various pitches up and down the neck; the fingerboard typically is formed with a convex radius that commonly varies between 9 and 16 inches. Further, it is known to those of ordinary skill in the art that the direction of the strings are generally parallel to both neck and the surface of the body despite instances where the string deviates from this direction at either or both the peg head or tailpiece. The tension of an individual guitar string is approximately 17 lbs at typical pitched conditions; anchoring or securely attaching the string holds the string to the instrument under normal conditions that often comprise an additional of 10 lbs of tension per string under other certain circumstances.

The second critical point can be created as a part of a combined bridge and tailpiece structure. Traditionally, the size of the bridge element is quite small so as to create a clearly defined single point of contact between the string and the bridge element. It is between these two points that the playable string length is typically determined, sometimes referred to as the scale length or harmonic length. Adjusting the relative distance between the first and second critical points is called harmonic tuning or setting the intonation. Some bridges structures are individually adjustable, that is for each string, relative to the nut for achieving a more precise harmonic tuning. Usually this adjustment of the second critical point for harmonic tuning is carried out first and then the strings of the instrument are tuned to playing pitch. Often referred to the "initial setup", it is not uncommon that further adjustment of the harmonic tuning is necessary for a variety of reasons, for example, including changing the brand of a string where the alloy of the strings is varied or when the gauge of strings the player chooses changes as well as "setting" the string by manually pulling on the string along the scale length in order to improve elasticity in the string at first tensioning before the string can confidently relied on to hold proper playing pitch during the life of the string.

Often the typical construction of the strings, particularly for guitar and bass, includes a plain end and, on the other end, a "ball end" which being a washer-like addition is wrapped by the string itself into a larger form to enable "fixing" or securing the string on the instrument to the tailpiece element; alternatives to the "ball end" include as known to those of ordinary skill in the art as "bullet ends" formed from metal and molded around the end of the string. The tailpiece is usually provides for an opening or recess sufficient in size to receive the strings of various diameters ranging from 0.007" to 0.070" or more while being smaller than the diameter of the ball end so as to limit the passing of the ball end through the opening or recess in order to secure or mount each of the individual strings to the body. The wrapping usually extends up to a ½" towards the plain end and as such the position of the tailpiece structure relative to the bridge element must insure that the wrapping does not extend over the second critical point when arranged on the instrument; this wrapping, under normal circumstances, is not subject to stretch compared to the rest of the string. Stable fine adjustments of these and other elements have been a longstanding problem for stringed musical instruments.

In the relevant art, "anchoring" strings is often referred to as attaching or securing a string and understood with the limitation that the anchoring is sufficient so that the string is fixedly attached or secured to the instrument under the typical tensioned conditions of the string that typically range from 16 to 20 lbs or greater.

Playing pitch or proper playing pitch or pitched string condition is generally understood by one of ordinary skill in the art to be the proper pitch of a guitar string relative to the remaining guitar strings when a guitar is played "in tune." For example, in a standard tuning arrangement, for a six string guitar, based on the standard A=440 Hz, the playing pitch of the $1^{st}$ string (highest) is tuned to note E (329.63 Hz), the playing pitch of the $2^{nd}$ string is tuned to note B (294.94 Hz), the playing pitch of the $3^{rd}$ string is tuned to note G (196.00 Hz), the playing pitch of the $4^{th}$ string is tuned to note d (146.83 Hz), the playing pitch of the $5^{th}$ string is tuned to note A (110 Hz), and the playing pitch of the $6^{th}$ string is tuned to note E (82.41 Hz).

In the Proelsdorfer U.S. Pat. No. 2,304,597, string tensioning devices placed on the tailpiece for fine tuning the pitch of the strings of violins, guitars and the like, were disclosed; such pitch adjustment is quite limited in range, comprising generally an interval falling between that of a whole tone and a major third at best, and designed to offer the tuning of the strings a minor adjustment of pitch after the general tuning is achieved with the tuning pegs on the head of the instrument which traditionally first provides for raising and adjusting the tension of the strings to pitch from an untensioned condition and then setting the string. This is regarded as fine tuning and the apparatus for doing so, the "fine tuners", usually comprise an adjustment knob or thumb screw.

It is known to those skilled in stringed musical instrument design and construction that various tremolos have been proposed and utilized for varying the tension of all the strings simultaneously for the purpose of creating a tremolo sound. Further, it is known to those skilled in the art that there are a great many commonly used names for such devices, such as tremolo, tremolo device, tremolo tailpiece, tremolo bridge, fulcrum tremolo, fulcrum tremolo bridge, fulcrum tremolo tailpiece, fulcrum tremolo bridge-tailpiece, vibrato, vibrato bridge, vibrato tailpiece, vibrato bridge tailpiece, etc.

In one specific species, known as the fulcrum tremolo, first introduced in Fender U.S. Pat. No. 2,741,146, shows and provides a device comprising a novel structure, which incorporates the bridge and the tailpiece. The portion supporting the bridge elements is called the bridge plate or the base plate. Further, both the bridge and the tailpiece elements connected to the base plate both move together as the fulcrum tremolo device is pivoted. Accordingly, a singular and defining aspect of the fulcrum tremolo is that the harmonic tuning is upset as the device is pivoted; and, accordingly, for an instrument equipped with a fulcrum tremolo, it is unique in that only restoring all of the strings to a proper pitched condition also simultaneously restores the harmonic tuning for all the strings. The base plate upon which the individual bridge elements are adjustably secured has a beveled ridge portion which is secured to the instrument body by six screws permitting pivotal movement about a fulcrum axis which varies the tension on the strings and produces the desired tremolo effect; in general, this device allowed for extensive dropping down of the pitch of all the strings and a modest upward capacity that further enabled the familiar mild pedal steel or Hawaiian guitar vibrato effect provided in gentle pivoting.

In this first vintage fulcrum tremolo, herein referred to as Type I, the metal bridge elements of '146 are loosely held in place by a spring loaded attachment screw arrangement pivotally secured through openings in a small folded portion of the base plate farthest from the fulcrum axis. The bridge elements also incorporate set screws for varying the relative height of the bridge elements and, therefore, height of the respective second critical points relative to the base plate and by extension, to the body and neck. Later iterations of Fender '146 included pivotally supporting the fulcrum tremolo relative to the body with a riser post arrangement adjustably connected to the fulcrum tremolo. The horizontal distance between the vertical centerline of each riser post is approximately 2.22". Further, the distance from the pivot point to the second critical point not including the variable heights of the bridge elements is 0.25" and the distance form the nut to the pivot is about 25.25" since the Fender Stratocaster for which this fulcrum tremolo first appeared provided a 25.5" scale length.

Typically, in order to facilitate the fulcrum tremolo pivoting about its fulcrum axis, counter springs, as a biasing element, are utilized to counteract or counter balance the pull of the strings. Counter springs are usually connected to the body of the instrument at one end and, on the other end, to a separate spring attachment means transverse the base plate, usually a block of metal, milled or cast or a combination of the two, which being secured to the bottom of the base plate by three screws 90 degrees to the base plate, is often called a spring block or inertia block. Upward pitch changes initiated by the use of the fulcrum tremolo in one direction can significantly increase the tension of individual strings.

One of the most troublesome problems with prior art for the fulcrum tremolo has been maintaining the "initial position" achieved at "initial setup" when all the strings are brought to proper playing pitch as the harmonic tuning is achieved. When a musician plays on the string there is usually some kind of string stretch over time that results in the overall tuning, and thereby, the "initial position" going out of balance. Specifically, when the pitch of the string changes, the position of the fulcrum tremolo and the position of the second critical point relative to the nut changes which then instantly alters the harmonic tuning.

This singular characteristic adds complexities in obtaining the primary goal of achieving a stable equilibrium between the force of the tension provided by the two to five biasing or counter springs (connected between the tremolo and the body) in relation to force of tension of all the strings (connected to the fulcrum tremolo and the end of the neck at the peg head by the tuning pegs or an optional nut arrangement that secures the strings without tuning pegs, etc.)

Accordingly, these and other inherences need to be addressed in achieving a true and lasting initial position for the fulcrum tremolo and has been the object of many inventions. In this inherent inter-dependant system of tensioning forces, contrary to the requirements of other tremolo or fixed bridge arrangements, (in the ideal instance where the essential conditions of the initial setup have been established and the appropriate tensioning force of the springs provisioned), the precise tensioning to proper playing pitch for any less than the total number of strings will inherently fail to achieve pitch and harmonic tuning for all of those strings attached to the tremolo.

Initial position refers to the position of the fulcrum tremolo and, therefore, the position of the second critical point on the bridge elements in relation to the first critical point on the nut such that the tension of the strings, each at the intended proper pitched condition, and the appropriately tensioned counter springs, renders a specific equilibrium point wherein the harmonic tuning for all the strings is simultaneously achieved. Often the pivot means is subject to wear and the tremolo does not always return to its initial position. Great care is required to establish the initial position since both aspects of adjustment are interactive and it simultaneously provides both the proper harmonic tuning and proper pitch tuning for each of the individual strings in order to enable a lasting "initial setup".

Improvements to the Fender '146 fulcrum tremolo have included using string clamps at the nut and at a point on the opposite side of the intonation point or second critical point on each of the bridge elements relative to the nut in order to limit string stretch to the prime vibratory portion of the string within these two points defining the scale length; and, separately, adopting a novel shaped beveled edge, called a "knife edge", adjustably supported by two screw-like members called riser posts positioned in the body to improve the return to initial position after pivoting the fulcrum tremolo device (Rose U.S. Pat. No. 4,171,661). The knife edge fulcrum pivot arrangement provides for the base plate to be positioned generally parallel to the instrument body and offers the novel possibility to increase the tension of the string for upward pitch changes.

In this second vintage fulcrum tremolo, herein referred to as Type II, the horizontal distance between the vertical centerline of each riser post is approximately 2.925". The distance from the pivot point to the second critical point, not compensating for the variable heights of the bridge elements, is about 0.425" and, approximately, 25.00" from the first critical point on the nut for instruments with a 25.5" scale length.

In Rose U.S. Pat. No. 4,497,236 a combination of the bridge element, the tailpiece and fine tuners replaced the "novel structure" of the Fender device so that within the limited range (typically within a range about the interval of a whole tone, for example from C to D in the Western diatonic musical scale) the strings could be re-tuned without first unlocking the string clamps at the nut. However, string stretch beyond the range of the fine tuners necessitated a correction that is tedious and time consuming involving unlocking the string clamps, re-tuning the strings, re-clamping, and further re-tuning the string with the fine tuners and then re-tuning all the other strings to re-balance the equilibrium point back to initial position. The string clamps of the Rose fulcrum tremolo are characterized by small blocks slideably mounted within a recess within a housing element connected to the bridge element. The player typically cuts the ball-end of the string off and then vertically places the cut end of the string within the recess between the block and a vertical surface located closest to the bridge element created by the recess and then bend in the direction of the tuning pegs—in a some instances, there are later designs that do not require the ball end to be cut off for the clamping mechanism to fixedly secure a string.

Therefore, for stringed musical instruments, as is known to those skilled in the art:

The second critical point is a clearly defined point on the bridge or individual bridge elements, the adjustment of which relative to the first critical point on the nut defines the length of the string or scale length and the adjustment of which is called harmonic tuning.

For fulcrum tremolos as originated by Fender U.S. Pat. No. 2,741,146, when pivoted:

Both the bridge portions and the string anchoring means, the tailpiece, simultaneously move about a common fulcrum axis;

The harmonic tuning is upset and is only restored when all strings are at proper playing pitch;

The tuning pegs or other means of tensioning the strings are inter-dependant with each other in obtaining initial position; and Various factors can disturb the equilibrium point between the tension of the strings and the tension of the counter springs and as a consequence disturb the initial position.

For those fulcrum tremolos equipped with fine tuners as with Rose U.S. Pat. No. 4,497,236, Storey U.S. Pat. No. 4,472,750 and Fender U.S. Pat. No. 4,724,737:

The bridge and tailpiece portions simultaneously move about the fulcrum axis when the device is pivoted for the tremolo effect;

The fine tuner screws simultaneously move with the bridge and tailpiece portions about the tuning axis when fine tuning; and Fine tuners are designed to offer the tuning of the strings a minor adjustment of pitch after the general tuning is first achieved, typically, by the tuning pegs on the head of the instrument; and Adjusting the tension of a string by the fine tuner knob alone simultaneously adjusts the harmonic and pitch tuning and can achieve tuning a string to proper pitch conditions while simultaneously achieving proper harmonic tuning.

For those fulcrum tremolos fitted with string clamps at the first and second critical points as in Rose U.S. Pat. No. 4,171,661, String stretch beyond the clamps at the first and second critical points is eliminated offering the most stability of tuning possible; and A plain end of the string is inserted between the bock and a vertical surface formed, transverse the general direction of the string, in a recess in the housing element and clamped by threading an adjustment bolt; the adjustment screw is pivotally positioned in the direction of the strings and the fine tuner adjustment screw is both transverse to the adjustment bolt and direction of the strings.

These two vintage fulcrum tremolos of the last century, Fender in the 50's and Rose in the 80's, are in part distinguished by the differing standards in the spacing between the riser posts, approximately, 2.22" and 2.925" typically. The individual parts of the two vintage designs were generally not compatible. Consequently, those who had guitars with the 2.925" spacing were limited to tremolos that had fine tuner arrangements and string locks and those guitars with the 2.22" spacing were limited to those tremolos without fine-tuners and string locks.

Often the musician is called upon to play in an ensemble where the other instruments are not tuned to a typical concert pitch. Accordingly, the musician must flatten or sharpen the initial tuning of all the strings on his instrument in order to meet the pitch requirements of other instruments. This retuning often disturbs the initial position because the tension of the counter springs has not been readjusted as well. Accordingly, the position of the base plate of the tremolo is either tilting away from or towards the body of the instrument which then can limit the range in which the tremolo can be activated. Steinberger U.S. Pat. No. 4,632,005 and Gunn U.S. Pat. No. 4,955,275 provide for an adjustable counter spring and utilize an adjustment knob that provides a means to vary tension of the counter spring and thereby maintain the equilibrium point between the tension of the counter spring and the tension of the strings on a non-fulcrum tailpiece tremolo, that is, a tremolo device where the bridge elements do not pivot with the anchoring means and, therefore, do not upset the harmonic tuning as such.

Further Improvements

Other improvements to bearing arrangements for fulcrum tremolos found expression in Hirayama U.S. Pat. No. 6,710,235 showing an electric guitar having a first critical point on the neck or nut and a second critical point defined to be on the tremolo base plate further pivotally secured to a body. In this patent the bearing arrangement includes a "hinge mechanism" for "supporting the base plate such that the base plate pivots relative to the body". Plain openings in the sides of the base plate, on the opposite side of the riser post vertical axis from the nut, each receive a pair of bearing devices supported by support pins or riser posts each variably positioned in the body on each side of the base plate and connected to a pair of brackets, each with bracket pins. Each riser post corresponds to one of the bearing devices and is located closer to the neck than the corresponding bearing device. "Each bracket is coupled to one of the support pins. Each bracket pin is coupled to one of the brackets and fits into the corresponding bearing device." The bracket pins create the pivot axis. Accordingly, since the pivot axis for the fulcrum tremolo is created by the bearing devices, the axis is on the opposite side of the riser posts relative to the nut by approximately 0.375" and creates a "feel" or resistance when pivoting the tremolo with the arm that is other than the "feel" of those designs deploying bearings placed on the centerline of the riser posts which is otherwise very close to where the traditional pivot is created. Misalignments of the bracket pins can cause binding in the bearings and defeat the primary goal of successfully returning the fulcrum tremolo to the initial position.

Further improvements in the fulcrum tremolo in the 90's and into the new millennium utilize various novel arrangements for pivotally supporting the fulcrum tremolo so that the base plate can be variably spaced from the surface of the body. Using bearing devices that include riser posts and at least a portion of the surface of a ball bearing or the like at the pivot point adjustably mounted to the body could encompass a range of bearing devices including self-aligning bearing arrangements affording a universal joint type movement to typical ball bearings and, as such, the bearing arrangements, thereby, not only provided greater adjustment for installations but substantially improved return to initial position after use of the tremolo while virtually eliminated the wear and tear associated with knife-edge and other related prior art (McCabe U.S. Pat. No. 5,965,831 ("'831"), U.S. Pat. No. 5,986,191 ("'191"), U.S. Pat. No. 6,175,066 ("'066"), U.S. Pat. No. 6,563,034 ("'034"), U.S. Pat. No. 6,891,094 ("'094) and U.S. Pat. No. 7,470,841 ("'841)).

The preferred bearing arrangement of '066, '831 and '094 which share the same parent application showed bearing devices supported on pins or shafts positioned between each of two fork-like portions formed in the base plate. The bearing devices are positioned within a bearing housing that received threaded riser posts for adjustably securing the fulcrum tremolo to the instrument body. The preferred bearing arrangement of '191 and '841 showed bearing devices supported on pins or shafts extending outwardly, each from the sides of the base plate, and positioned within a bearing housing that received threaded riser posts for adjustably securing the fulcrum tremolo. A preferred bearing arrangement of '034 and '841 showed bearing devices supported on a single bearing axle or shaft located at the leading edge of the base plate closest the nut within a tube-like housing connected to housings for receiving the bearing devices. The bearing axle is received by a bearing axle housing connected to threaded riser posts for adjustably securing the bearing arrangement and, thereby, the tremolo. The ball bearing means in '066 and '094 for adjustably mounting the fulcrum tremolo to the instrument body are arranged in a bearing housing supported within a fork-like structure in the base plate. One of the two bearing arrangements of '191 and '841 require non-standardized in placement of the pivot axis in view of Type I and II whereas another design as was the case of '034 bearing arrangements did not.

Further, prior collaborative efforts with Gary Kahler and Geoffrey McCabe, U.S. application Ser. No. 13/005,428, ("'428"), for example, provide an improvement to the bearing arrangement with an integrated riser post, provided by, in one instance, physically integrating or physically combining the bearing axle housing with the riser posts such that threading the riser posts into inserts in the body secures the bearing axle, the bearing axle housing, the bearing element and the fulcrum tremolo, and therefore, the second critical point, relative to the instrument body and neck. An improved bearing axle, formed with an enlarged plain end having a larger diameter greater than the rest of the bearing axle and a second threaded end, extends between and through a first integrated riser post formed with a enlarged plain opening or smooth bore for receiving the enlarged plain end and a second integrated riser post that has a threaded opening for receiving the threaded second end enabling the first end of the axle to be slideably and adjustably positioned within the first riser post and the second end of the axle is threadedly secured to the second riser post. The second riser post threaded portion also provides a recess portion connected to a ring spacer placed around the bearing axle for spacing the bearings relative to the first integrated riser post when the bearing axle is threaded into position. Since the bearing axels pass through the integrated riser posts, they must be rotated in 180 degree increments to adjust height. In cases where the instrument is constructed with a "bolt on" neck, neck shims can be placed between where the neck is secured to the body to make minor adjustments to compensate for this design requirement; in some cases, this requirement can lead to installation issues where such precision is inadequate in general or, more particularly, when the instrument has a "set" neck or glued to the body which precludes the use of neck shims to meet the otherwise broad installation requirements for guitars equipped with either Type I or Type II vintage formats.

The threaded end of the bearing axel is inserted though the plain end of the first riser post and pushed through the first set of the bearings, passing through the second set of the bearings at the other end. A ring spacer is then positioned over the threaded end of the bearing axle before making threaded contact with threaded portion of the second riser post. Threading the axle into the threaded portion of the second riser post, secures the ring spacer between with the inner ring of the outside bearing of the related bearing set and within the recess formed in the second riser post near the threaded portion, and positions the larger plain end of the bearing axle against the inner ring of the outside bearing of the other bearing set to variably secure the bearing arrangement connecting the fulcrum tremolo pivotally to the instrument body. Thus, the plain end is slideably positioned within a round opening in the first riser post to adapt to distortions in the dimensions of the stud spacings as the axle is threadedly located into the preferred position to secure the bearing assembly and provide the fulcrum axis, however, there are further instances where the fulcrum tremolo base plate is positioned within a recess within the instrument body limiting access to the openings in the integrated riser post for installation of the bearing axel.

The evolution from fine tuners to macro-tuners for use on string musical instruments in general or a guitar equipped with a fulcrum tremolo provides a self-contained intonation module that includes a novel modular integrated bridge-tailpiece structure, adjustably secured to the base plate of a fulcrum tremolo for achieving harmonic tuning, wherein the improvement includes, in various iterations, the broad provision, located on the opposite side of the bridge element from the nut, a macro-tuner to bring and adjust the strings to playing pitch from an untensioned or relaxed condition circumventing the re-tuning limits imposed by the Rose style clamps/fine tuner arrangement and other limited range tuners in several novel configurations selected from a group comprising a bridge element, the tailpiece element, an adjustment screw or bolt, a sliding and/or pivoting elongated member. The range of the macro-tuners is unrestricted so as to allow for various conditions including but not limited to conditions such as guitars with tuning pegs, or alternately, a nut arrangement that secures the string(s) at the end of the neck. Further distinguishing the art, various improvements comprising string clamps and/or gripping arrangements positioned between the second critical point and the tailpiece portion are provided so the length of the string between these two areas is substantially inextensible in each of the macro-tuner examples. In each case the improvement comprised a novel portion that is positioned in a creative position for limiting the stretch of the string as outlined above while allowing the adjustment knob to be threaded to achieve macro-tuning. The design of the macro-tuners in '831 requires the string to be bent severely to achieve the necessary tuning. This arrangement, although effective, makes tuning at the higher pitches difficult and in some cases may introduce string breakage. Both '191 and '841 present a novel tuning element comprising an elongated member through which the string passed that stretches the string generally along the axis of the string integrated with a continuously variable fork-like clamping or collet-like arrangement connected to an adjustment knob. By threading the adjustment knob, the string is macro-tuned to playing pitch as the fork-like portion is drawn within a restricted portion to clamp the string and, thereby, render the string "inextensible" between the fork-like clamping portion of the tuning pin and the bridge element. Despite meeting the goal of a reduced part count per intonation module, the fork-like portions required varied dimensions requiring multiple sizes to address the variety of string diameters, which then added burdensome complexity to manufacture.

Macro-tuners refer to tuners with the capacity to raise and adjust the tension of the strings from an untensioned condition to a proper playing pitch, and as such provide for alternate tunings and compensation for substantial string stretch during the life of the string essentially without additional means.

McCabe '841 and '191 provide a Global-tuning mechanism on the fulcrum tremolo that compensates for the problems associated with varying humidity and temperature on the instrument as well as other factors, such as differing string specifications, etc. that could adversely affect the instrument's geometry and, therefore, the delicate balance achieved at the time of initial setup. For example, in some instances, a change in humidity could cause a reduction in the intentional slight concave "bow" or "relief" in the neck achieved during initial setup and, otherwise, straighten the neck somewhat by a minute dimension, generally less that 0.025", thereby, increasing the harmonic length compared to the length achieved at the time of initial setup. This condition simultaneously causes the strings to sharpen collectively by, for example, 10 cents, (where 100 cents comprise a change from one note to another, say "E" to "F"), in which case, the thumbwheel is used to collectively lessen the tension of the counter springs or biasing element, which then simultaneously contributes to reestablishment of the original relief of the neck and the strings are otherwise returned to pitched tuned condition at which time the harmonic tuning will essentially return to the same tuning as achieved in initial position.

Further, a Global-tuner, in a preferred embodiment includes a thumbwheel portion, provides a simple and quick means for the musician to adjust the initial position of the fulcrum tremolo in order to meet the pitch requirements in varied situations. Further, the Global-tuner, in re-establishing the initial position, allows the full range of pivoting the fulcrum tremolo.

Accordingly, Global-tuners refer to an adjustment device added to a fulcrum tremolo and its counter spring arrangement with the capacity to essentially re-establish the equilibrium point, created at the time of the initial setup by the tension of the counter spring(s) and the tension of the strings, in order to compensate for changes in tension requirements on the strings and/or the counter springs due to various factors. The Global-tuner preferably employs an adjustment knob or thumbwheel for providing continuously variable adjustment of the tension in the strings by varying the relative distance between the spring attachment portion connected to the base plate of the fulcrum tremolo and the attachment point of the springs to the body of the instrument.

Global-tuners of '191 and '841 comprise a secondary spring holder element formed from an additional simple flat plate approximately 0.135" thick connected to the counter springs and threadedably secured by a thumbwheel to the portion of the unitary component functioning as spring block called a spring blade. Further, the Global-tuner invention is shown incorporating the unitary component also having about 0.135" plate thickness in general, and, in particular, for the spring blade portion that supported the thumbwheel element and at least one guide pin or stabilizing element used to impede rotation of the secondary spring block as the thumbwheel is employed for adjusting the tension of the counter springs. Stabilizing springs are used to ensure the position of the secondary spring block, and, thereby, the return to initial position, after pivoting the tremolo. The combined size of the spring blade and the thumbwheel is about 0.335" which is dimensioned to just fit in the traditional tremolo spring block recess or "pocket" in the body. These Global-tuner arrangements, designed as part of the unitary component took advantage of the reduced thickness of the spring blade, were not fashioned to fit the spring blocks as found in the vintage Type I and II fulcrum tremolos and their variants having a thickness generally about 0.350" or so.

Other improvements as disclosed in McCabe '831, '066, '094 and '191 included "tiers" or "steps", formed into conventional as well as into unitary component base plate of the fulcrum tremolo, one for each bridge element or intonation module, that in displacing their relative positions create a radius for the strings in relationship to the radius of the fingerboard that both improve the coupling between the bridge element and the base plate and provide for an instance where each of the bridge elements can otherwise be of a single set of dimensions. Achieving the conventional dimensions for varied fingerboard radii, say, from 9 to 16 inches, can be extensive and expensive for either base plate formats. The use of individual bridge shims placed between each intonation module, for example, comprising at least the bridge element and the base plate or base plate portion of the fulcrum tremolo to address these varied requirements is known.

An alternate means to tuning pegs on the head or on the body of the instrument has been proposed in a quick tuner arrangement design in '094 wherein the tuning device, now known to those skilled in the art as a "semi-headless tuner" or "two-step quick macro-tuner", has the capacity to individually anchor and bring the strings to playing pitch quickly and then accomplish fine tuning by a separate means and which in while can be positioned on either the head or the body of the instrument. One primary tuning means is afforded by a forceps-like clamp at one end of a L-shaped lever arm arrangement with at least one "tooth" engaged with another "tooth" on a holding bracket to hold the tensioning mechanism in a fixed position for achieving the desired playing pitch. This arrangement can further provide for a plurality of locking positions that correspond to a variety of pre-set tuned conditions for each of the associated strings.

SUMMARY OF THE INVENTION

Improved Tuning Mechanisms

One primary object of the invention is to provide an enclosed clamping mechanism integrated into a macro-tuner mechanism for which the intonation module base including the bridge element and related features are no longer required for the clamp to be successful. The improvement is based on an enclosed sliding apparatus for a string on a stringed musical instrument that includes a hollow cylindrical-like tuning element comprising a first tailpiece at one threaded end and, in a preferred embodiment, a novel compact enclosed clamping mechanism positioned at the other end nearer the bridge element that will secure all common string diameters and constructions. A set-screw, threadly engaged within the hollow cylindrical-like tuning element, is operative to pivot lever around a transverse pin within an enlarged recess to a position where the centerline of the lever is oblique to the centerline of the clamping mechanism to secure the string. The enlarged recess formed to receive the clamping mechanism is limited in size to the same overall cross-section dimensions and/or diameters of the tuning element so as to not impede the sliding macro-tuning function. Accordingly, the novel compact enclosed clamping mechanism is a completely stand alone design housed within the hollow tuning element. An intonation module body formed to slideably receive the hollow cylindrical-like tuning element comprising the first tailpiece threaded end connected to a tuning knob, turning the knob is operable to slideably position the hollow cylindrical-like tuning element to variably tension a string. Interior walls of the intonation module base are formed to cooperatively mate with formed features of the hollow cylindrical-like tuning element to impede rotation when the tuning knob is turned for the macro-tuning feature.

Another object of the invention is to provide two separate improvements over McCabe/Kahler application '428 comprising an improved adjustable bearing pivot means for a fulcrum tremolo for facilitating broader installation requirements. In two preferred embodiments, one features a novel integrated riser post with an enlarged stepped access for a bearing axel comprising a enlarged plain end that allows the bearing axel to be installed in instances where the tremolo is positioned within a recess in the body and another integrated riser post design comprising an adjustable inner sleeve arrangement that provides for a continuously variable positioning of the bearing axel provision within the 360 degrees of rotation of the riser post to offer extremely fine height adjustments of the tremolo and, thereby, the bridge element relative to the instrument body. A third embodiment would include both features in one integrated riser post.

Another object is to provide an improved Global-tuner design integrated into traditional sized and/or oversized replacement spring block in an arrangement proportioned to retro-fit vintage Type I and Type II fulcrum tremolo and their variants. These novel arrangements further include ease-of-use provisions such recesses formed to include the greater portion of the thumbwheel itself with specific access areas for the thumb or fingers as well as any combination of stabilizing elements such as a compression spring and guide pin combination or a U-shaped spring, for example, to ensure that the global tuner installation would minimize, if not eliminate, any customization of the body in order to fit into the pre-existing tremolo routings. In use the secondary spring holder is positioned close to the modified spring block during initial setup to minimize over all size although there is some latitude in position since during the pivoting of the tremolo, the secondary spring block generally swings away from the counter spring recess in the underside of the body. Typically, less than a full turn of the thumbwheel under normal circumstances is all that is required to re-establish initial position.

Yet, another object is to provide an insert plate as an alternative to individual tiers formed into the traditional base plate arrangement or unitary component of a fulcrum tremolo or as an alternative to the use of individual shims that are, in either case, used to displace each of the bridge elements or similar to generally follow a radius found in the fingerboard. The insert plate is provided in a form comprising at least two steps or tiers of varied and suitable dimensions that can be added to the tremolo base plate to displace more than one bridge element or intonation module. For example, the first and sixth string height can be adjustably determined by the riser posts on each side of the tremolo, wherein adding a plate for the inner four strings, in a conventional six string guitar, for example, with two steps or tiers having, say, one dimension of 0.029" for the second and fifth strings and 0.044" for the third and fourth strings relative to the first and sixth strings, could comprise a collective radius for a 12" radiused fingerboard. Other dimensions such as 0.022" and 0.033", for example, would be provided in alternative plates to address other radius requirements wherein selectively adding such an adaptor plate to the generally flat, or flat recessed, portion of the base plate formed to received such a plate, would offer an inexpensive and comprehensive means to address various bridge height requirements, while maintaining improved coupling; obviously, the insert plate could have other variations such three tiers which could in some cases accommodate six or more strings, etc.

The various features of novelty, which characterize the invention, are intended to improve the upward spiral of Light and are pointed out with particularity in the claims annexed to and forming a part of this disclosure. For a better understanding of the invention, its operating advantages and specific objects attained by its use, reference should be had by the accompanying drawings and descriptive matter in which there are illustrations and described preferred embodiments of the invention.

While specific embodiments of the invention have been shown and described in detail to illustrate the application of the inventive principles, it will be understood that the invention may be embodied otherwise without departing from such principles.

DESCRIPTION OF THE DRAWINGS

In the drawings:

FIGS. 3*a* and 3*b* are close up views of an improved clamping method on the forward end of the tuning element showing an improved clamping lever with a radiused lower portion in an open and clamping position.

DETAILED DESCRIPTION OF THE INVENTION

Figure 1:
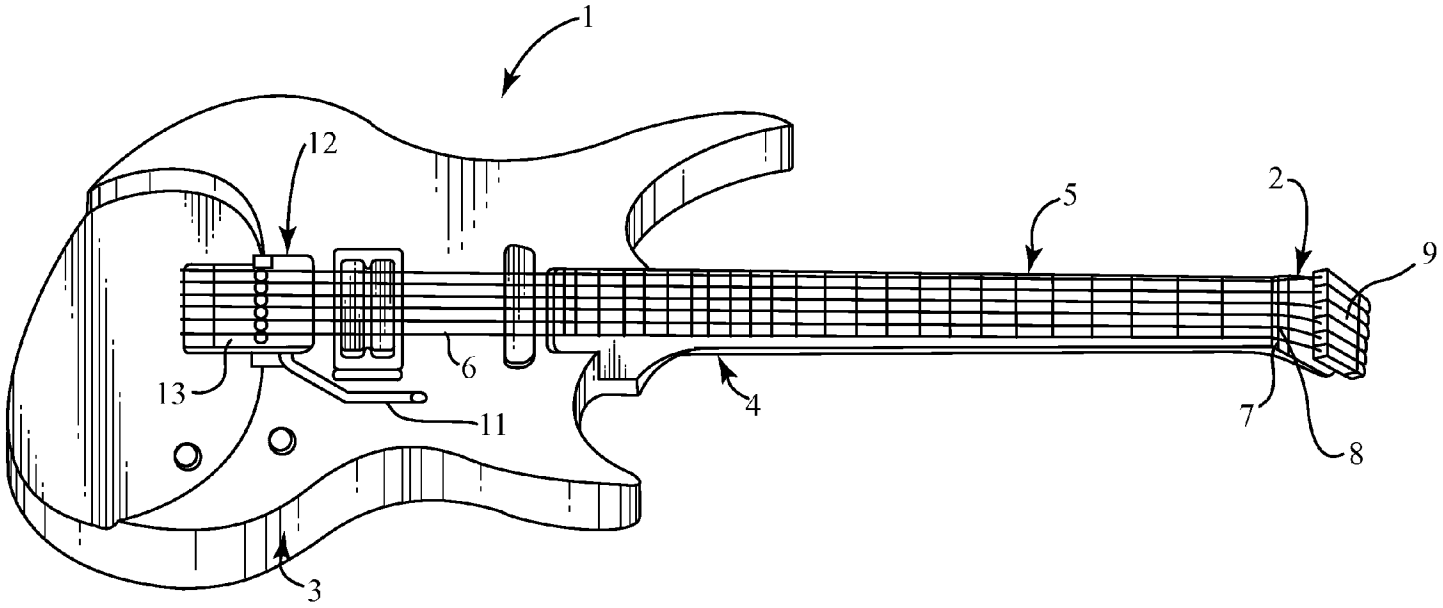
FIG. 1 is a plan view of an electric guitar embodying the present inventions.

In FIG. 1, an electric guitar 1 is illustrated comprising head 2 at one end, a body 3 at the other end, with neck 4 extending between head 2 and body 3. Six of each string 6 extend from head 2 to body 3 over neck 4. Neck 4 forms fret board or fingerboard 5 for guitar 1. At head 2, each string 6 extends over nut 7 forming first critical point 8 for each string 6. Nut 7 is located at the transition of neck 4 to head 2. Each string 6 is secured on head 2 by a corresponding element 9. On body 3, strings 6 are secured to fulcrum tremolo 10. Fulcrum tremolo 10 has arm 11 for pivoting tremolo 10 to provide the vibrato effect on the strings. Fulcrum tremolo 10 has six intonation modules 12, one for each string 6. By manipulating tremolo arm 11, the entire fulcrum tremolo 10, except in the one preferred embodiment of a bearing arrangement as well as riser posts and inserts, can be pivoted about axel 23 forming pivot axis 40 to achieve the desired tremolo effect.

Intonation module 12 incorporating the function of bridge element 42 and tailpiece 49 in its structure present improvements to the macro-tuning invention to adjustably fix one end of string 6 to the instrument 1 at a second tailpiece in a position determined by clamping lever 60 utilizing enlarged radiused contact portion 69 in variable contact with string 6. The enlarged radiused portion 69 provides continuously variable or self-adjusting clamping point 68 determined by the diameter of string 6, which varies for each string and string set gauge. Intonation module 12 is slideably positionable on base plate 14 to adjust the relative distance between first critical point 8 and second critical point 16 or the harmonic tuning as such.

The invention is shown for on electric guitar 1 with six strings 6 and it should be understood that the invention could be used on a variety of stringed musical instruments. In body 3 of guitar 1 there are electric pickups shown without numbers. In the following description, fulcrum tremolo 10 will be described in greater detail. Fulcrum tremolo 10 comprises a second critical point 16, one for each string 6, sometimes characterized as an intonation point, witness point or bridge point.

Figure 2:
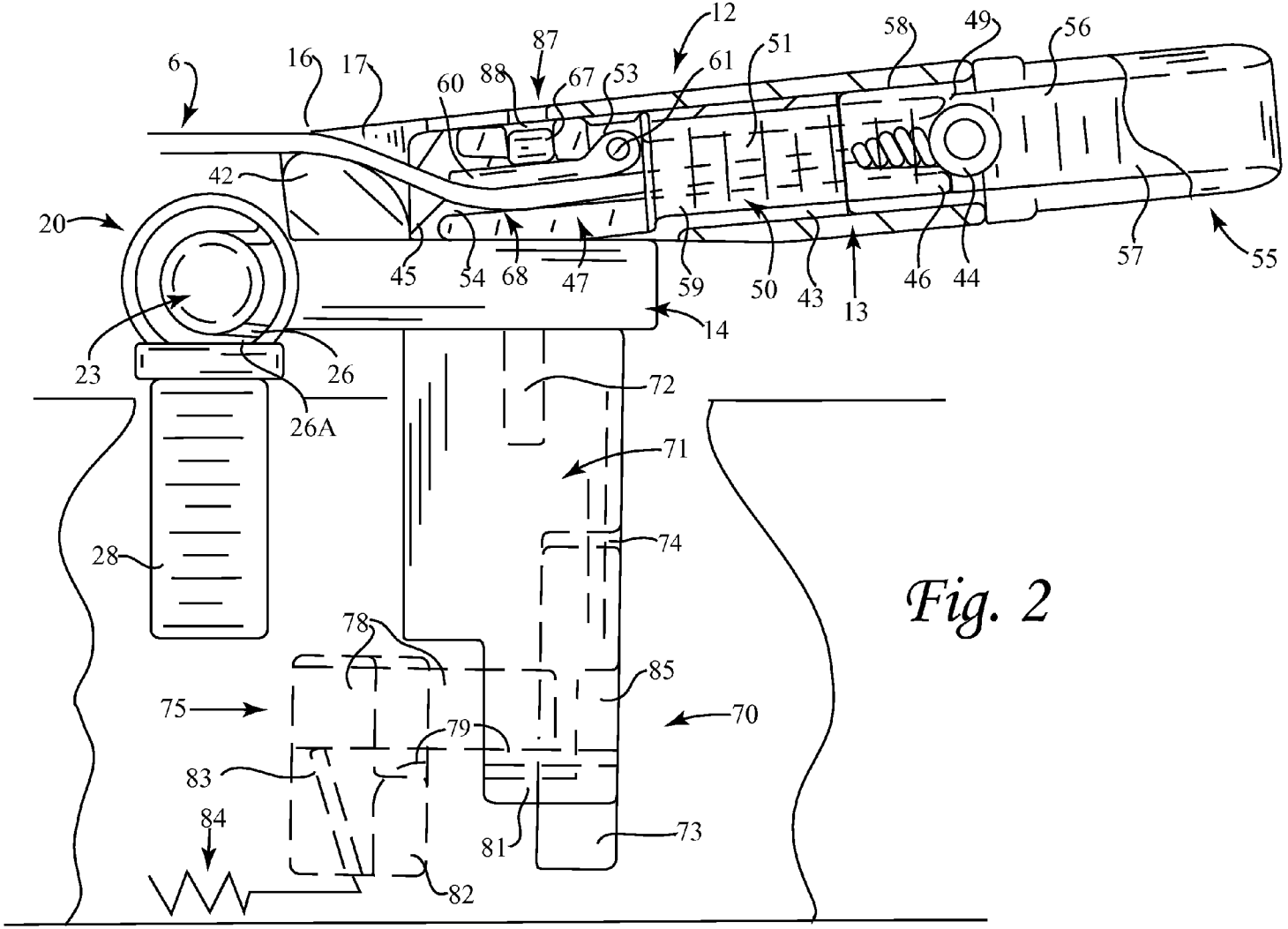
FIG. 2 is a side view of the tremolo mechanism showing the cross-section of improved macro-tuners and enclosed clamping element, improved riser posts in the bearing arrangement as well as the improved global tuner of the present invention as used in the electric guitar.

In FIG. 2 displays fulcrum tremolo 10 in a partial cross-section side view. Second critical point 16 is located on intonation module 12 in the area of the string opening 17 closer nut and/or first critical point 8. The leading-edge portion 13 of base plate 14, the portion closest to nut 7, can comprise bearing housings 20. Bearing housing 20 adjustably supports base plate 14 pivotally relative to body 3. Clamping element 60 pivots about pin 61 and includes enlarged radiused underside 64 to provide a variable clamping point 68 determined by the individual diameter of any given string 6. Further, variable clamping point 68 is shown in a position determined by a larger string, approximately 0.050" in diameter, closer the ball end of the string compared to the closed position shown in FIG. 3*b*. Intonation adjustment screw 18 (not shown) is threadedly connected to intonation module 12 through base plate 14 slot 19 (not shown) for adjusting harmonic tuning.

Figure 4:
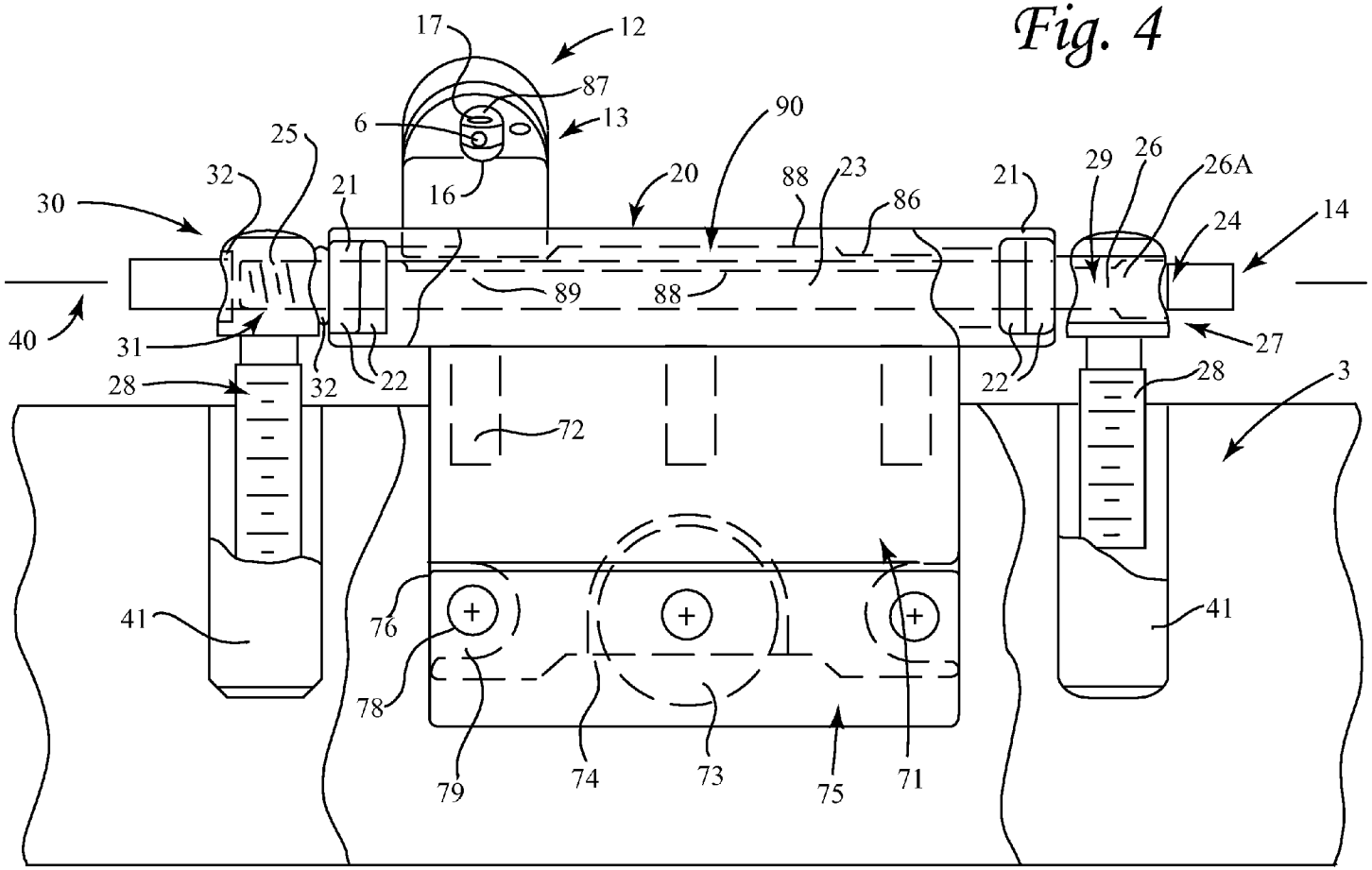
FIG. 4 is a front view of the tremolo mechanism showing the improved macro-tuners, improved riser posts in the bearing arrangement, multi-tiered insert plate as well as the improved global tuner of the present invention as used in the electric guitar.

In FIGS. 2 and 4, the improved fulcrum tremolo is shown with intonation module 12 that includes base 13. Base 13 is adjustably secured to base plate 14 of fulcrum tremolo by reverse thread screws (not shown) through slots (shown in FIG. 6). Adjusting the screws permits longitudinal movement of base 13 and associated parts for harmonic tuning of string 6 in initial position in a conventional manner.

In FIGS. 3*a* and 3*b* shows greater detail in improved clamping lever 60 comprising a enlarged radiused underside 64 to provide clamping point 68 in a position depending from various diameters of string 6 in order to provide a sufficient variable contact surface area 69 to avoid string breakage during clamping and fixedly secure string 6 and, thereby, simultaneously transfer the securing of string 6 from the tailpiece portion 49 to variable clamping point 68 and render string 6 inextensible within normal operating conditions between variable clamping point 68 and hollow tube second end 46. In the closed position shown in FIG. 3*b*, a variable clamping point is shown in a position determined by a thinner string 6, approximately 0.010" in diameter, closer the bridge element compared to the closed position shown in FIG. 2 for string 6 having a larger diameter.

There are five generally independent improvements, an improved macro-tuner tuner arrangement comprising improved clamping element 60, and a first improved integrated riser post with slotted recess 26 for receiving a bearing axle from a direction transverse the pivot axis and a second improved riser integrated post that includes separate threaded outer sleeve-like portion 37 to allow alignment to bearing axis 40 regardless of the position of riser post 27 within threaded insert 41 in body 3, multi-tiered insertion plate 90 and an improved Global-tuner 70, which, in the preferred embodiment, all work cooperatively together.

Macro-Tuner with an Improved Clamping Element

Figure 5A:
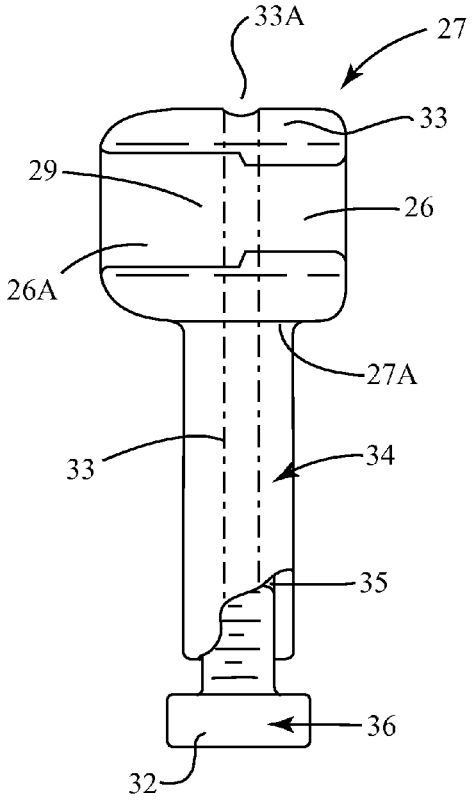
FIGS. 5*a* and 5*b* are views of an improved adjustable integrated riser post arrangement to provide riser post heights achievable between the 180 or 360 degree increments of rotation the integrated riser post otherwise require as well as further illustrate the two-step transverse installation slot.
Figure 5B:
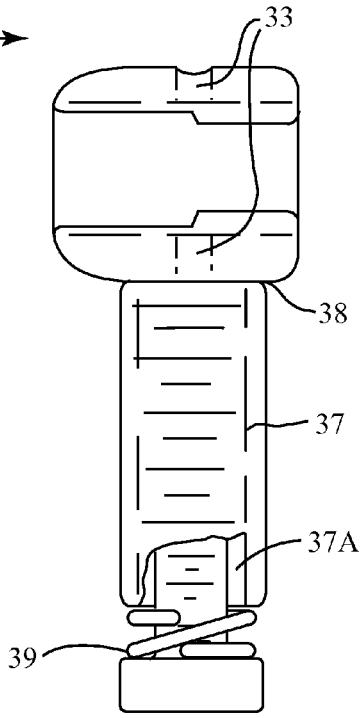

An improved macro-tuner arrangement as shown in FIG. 2 mounted on a fulcrum tremolo is presented providing an improved continuously self-adjusting variable string clamping arrangement shown in FIG. 2 and in detail in FIGS. 5A and 5B.

Intonation module 12 is variably secured to fulcrum tremolo 10 base plate 14 by adjustment screw (not shown) within base plate slot (not shown) to adjustably establishing harmonic tuning in initial position. Intonation module 12 is generally tubular in form with a closed end providing bridge element 42 and hollow cylindrical inner portion 43 of base 13 comprising limiting inner walls 45 closer bridge element 42 sufficiently dimensioned to cooperatively mate with tuning element 50 first portion 47 limiting walls 52 (not shown) to impede rotation of tuning element 50 and receive smooth outer portion 58 of tuner adjustment knob 55 at open end.

Tuning element 50 first portion 47 further comprises enlarged opening 53 and slotted portion 54 connected to hollow second portion 49 further comprising threaded portion 59 through which string passageway 51 collectively extends to threadably cooperate with inner threaded portion 56 when threading tuner knob 55.

Clamping lever 60 is pivotally supported by pin 61 within enlarged opening 53 comprising upper leg 62 and lower leg 63 comprising enlarged radiused underside 64 of leg 63. Upper leg 62 further comprises upward bend 65 that in a first open position freely mates with upper fork bevel 66 within slotted portion 54 and in a second open position enlarged radiused underside 64 makes critical contact with string 6 positioned between lever 60 and enlarged radiused underside 64 of leg 63 at clamping point 68 at a variable distance relative to tailpiece 49 determined by the diameter of string 6. For example, if string 6 has a diameter of, say 0.050", as shown in FIG. 2, clamping lever 60 will pivot about pin 61 to a lesser degree and establish clamping point 68 closer to pin 61 relative to the instance when string 6 has a diameter of 0.010" as shown in FIG. 3B and requires lever 60 to pivot to a greater degree. In this comparison, clamping point 61 advances toward the nut relative to the position of clamping point 68 for 0.050" string 6 to ensure enlarged radiused underside 64 provides a clamping area 69 for establishing a stable clamping point 68 regardless of the pivoting requirement—see comparative arrows marked with numeral 68 located between FIGS. 3A and 3B. In the preferred embodiment, combining the clamping lever 60 with tuning element 50, threading clamping set screw 67 in the direction base plate 14 urges enlarged radiused underside 64 to create a clamping point 68 within variable contact surface area 69 to both clamp string 6 to avoid string breakage during clamping and fixedly secure string 6, and, thereby, simultaneously transfer the fixing of string 6 from first tailpiece portion 49 to variable clamping point 68, thereby, comprising a second tailpiece, to render the string inextensible between variable clamping point 68 and hollow tube second end 46.

Tuner knob 55 comprises enlarged recess 57 sufficient in size to provide access to tailpiece portion 49 formed at second end 46 so ball end 44 of string 6 does not engage the enlarged recess 57 when threading tuner knob 55 to vary tension in the string.

The player first ensures tuning element 50 is positioned closest to bridge element 42 so as to align pin hole access 87 in the base 13 with, in the preferred embodiment, hex socket 88 (not shown) of clamping set screw 64 to thread clamping set screw 64 to ensure clamping lever 60 is disengaged from actively clamping string 6. Inserting the plain end of string 6 of the musical instrument 1 through string passageway 51 extending from second end 46 of tuning element 50 through first end 45 and clamping lever 60, sloping upwardly and forward through hollow portion 43 to continue out string opening 17, over bridge element portion 42 comprising second critical contact point 16, over neck 4 towards nut 7 as ball end 44 or similar at one end of string 6 is positioned against second end 46 of tuning element 50 forming first tailpiece 49, where, then, plain end of the string is secured at the other end of neck 4 to element 9 in a generally slack or untensioned condition.

Clamping set screw 67 is then threaded to urge clamping element 60 to pivot about pin 61 to secure string 6 a clamping point 68 at a position determined by the string diameter in view of radiused underside 64 of pivoting clamping lever 60 to form second tailpiece 48. Threaded inner portion 56 is connected to threaded outer portion 59 so that rotating tuner knob 55 slideably positions tuning element 50 relative to bridge element 42, and, therefore, string 6, to macro-tune string 6 as hex socket 88 (not shown) of the clamping set screw 67 is withdrawn out of view within intonation module 12. Subsequent adjustments to pitch are easily within the capacity of this arrangement to meet requirements of macro-tuning. It is to be understood that the advantages of improved clamping lever 60 providing the radiused clamping surface 64 could be easily adapted to fine-tuner arrangements as well.

Improved Integrated Riser Posts

FIG. 4 is a front partial cross-section view of the improved bearing arrangement connected to base plate 14 with tiers 15 for variably supporting intonation module 12 (only one is shown) comprising second critical point 16 further connected to inserts 41 positioned in body 3. The bearing arrangement comprises tube-like bearing housing 20 further comprising recesses 21 in each end of bearing housing 20 to receive bearing elements 22. First integrated riser post 27 is shown with transverse threaded portion 28 comprising smooth bore portion 29 further forming slotted recess 26. Second integrated riser post 30 is shown with transverse threaded portion 28 and threaded opening portion 31 further comprising annular flange 30*a*.

Bearing axle 23 further comprises enlarged first end 24 having a diameter generally larger than the rest of bearing axle 23 and which corresponds to the diameter of smooth bore portion 29 to limit movement of bearing element 22 along the length of the bearing axle in one direction and to limit contact between bearing element 22 and first integrated riser post 27 in the other direction. Second integrated riser post 30 further comprises at least one annular flange 30*a* to space bearing 22 and bearing axel housing away from threaded opening portion 31. Threaded second end 25 corresponding to threaded opening portion 31 has a diameter equal to or less than the diameter of the bearing axle and each bearing axle portion 24 and 25 having a length substantial enough to secure bearing axle 23 firmly and variably to first integrated riser post 27 and second integrated riser post 30.

In one embodiment, smooth bore portion 29 comprises slotted recess 26 sufficiently dimensioned to receive enlarged first end 24 from a direction transverse to pivot axis 40 wherein enlarged first end 24 is first positioned within slotted recess 26 as second threaded end 25 is then variably secured to second integrated riser post 30 to adjustably position bearing axel 23 relative to integrated riser posts 27 and 30 to address minor distortions in the distance between the inserts 41 found in individual instruments.

Further, ball bearing elements 22 further comprising an inner and an outer ring; the specific diameter of plain end 24, while typically the same dimension as the outer diameter of the inner ring, must be less than the inner diameter of the outer ring so as to ensure enlarged plain end 24 while making variable contact with the inner ring, does not engage any portion of bearing 22 in a way that would bind with or inhibit the free rotation of fulcrum tremolo 10 about the pivot axis 40.

Shown in greater detail in FIGS. 5*a* and 5*b* as well as in part in FIG. 2, in a second preferred embodiment, integrated riser post 27 comprising slotted recess 26 having a first dimension sufficient in size to limit enlarged first plain end 24 to be positioned from a direction transverse within smooth bore portion 29 and slot 26*a* having a second dimension sufficient in sixe to permit both bearing axel 23 and enlarged first end 24 to be positioned within smooth bore portion 29 from a direction transverse to pivot axis 40. In practice, the installation of the integrated riser posts 27 and 30 includes rotating threaded portion 28 in 180 or 360 degree increments respectively within inserts 36 in body 3 to establish the center line axis of bearing axle 23 as pivot axis 40 and the position of second critical point 16 relative to body 3.

Bearing axle 23 threaded second end 25 is extended first through bearings 22 within bearing housing 20 to make threaded contact with riser post 30 threaded opening portion 31 to allow enlarged first plain end 24 to be positioned within slotted recess 26*b* from a direction transverse pivot axis 40. Further, threading second threaded end 25 draws enlarged first end 24 within slotted recess 26 in alignment with pivot axis 40 to secure bearing 22 on one side and against annular flange 30*a* to space bearing element 22 away from integrated riser post 30 to adjustably secure fulcrum tremolo 10 to body 3.

As shown in FIGS. 5*a* and 5*b*, integrated riser posts 27 and 30 require rotating threaded portion 24 to a position defined in 180 or 360 degree increments relative to riser inserts 41 to align to pivot axis 40. In this preferred embodiment, threaded portion 28 further comprises a separate outer threaded sleeve element 37 further comprising inner smooth hollow interior 37*a*. Integrated riser post 27 further comprises inner cylindrical portion 34 operable to rotatably connect within hollow interior 37*a* to align riser post 27 to pivot axis 40 in any position separate sleeve element 37 is relative to riser insert 41. Inner cylindrical portion 34 further comprises upper surface 27*a* in bearing contact with upper portion 38 of sleeve element 37 and a threaded inner portion 35 to receive adjustment screw 36. Adjustment screw 36 further comprises head 32 having an outer dimension greater than inner cylindrical portion 34 and less than the outer diameter of sleeve element 37 and recess 36 (not shown) in the end of the threaded portion of adjustment screw 36 for receiving an adjustment tool. Adjustment spring 39 is variably positioned between head 32 of adjustment screw 36 and threaded inner portion 35 of cylindrical portion 34. Integrated riser post 27 further comprises opening 33 extending from pin hole 33*a* through to threaded inner portion 35 and aligned to recess 36. Inserting a tool into pin hole 33*a* and through opening 33 to access recess 36 is operable to position adjustment screw 36 within threaded interior portion 35 to compresses adjustment spring 39 and fixedly secure upper portion 38 of sleeve element 37 to upper surface 27*a* and, thereby, inner cylindrical portion 34 of integrated riser post 27. Accordingly, integrated riser post 27 can be aligned to axis 40 at any increment within the 360 degrees of rotation within inserts 41 in body 3 to pivotally support fulcrum tremolo 10 in relation to fingerboard 5 or body 3 in obtaining optimal initial position.

Improved Global Tuner Arrangement

In FIG. 2 and FIG. 4 global tuner 70 is shown comprising a conventional (or enlarged) spring block descending in a direction transverse from base plate 14 comprising transverse element 71 secured by (three) attachment screws 72 in an otherwise conventional manner. A portion of thumbwheel element 73 positioned within thumbwheel recess 74 of spring block 71 includes threaded portion 73*a* further extending through spring block 71 to variably position secondary spring holder 75 in a first position within secondary spring holder recess 76 in spring block 71. First recess 81 in spring block 71 flush with second access 82 in secondary spring holder 75 allows for manual access to activate thumbwheel element 73 for global tuning Guide pin recesses 79 receive guide pins 78 positioned within compression springs 77 (not shown) between secondary spring holder 75 and spring block 71 to slideably connect to associated spring block 71 openings 85 to impede rotation of secondary spring holder 75 when thumbwheel element 73 is threaded. Traditional tremolo counter springs 84 are connected secondary spring holder 75 spring holes 83 on one end and to body 3. Threading thumbwheel 73 variably positions secondary spring holder 75 to vary the tension of counter springs 84 relative to the tension of string(s) 6 to adjust initial position.

Separate Multi-Tiered Insert Plate

Figure 6:
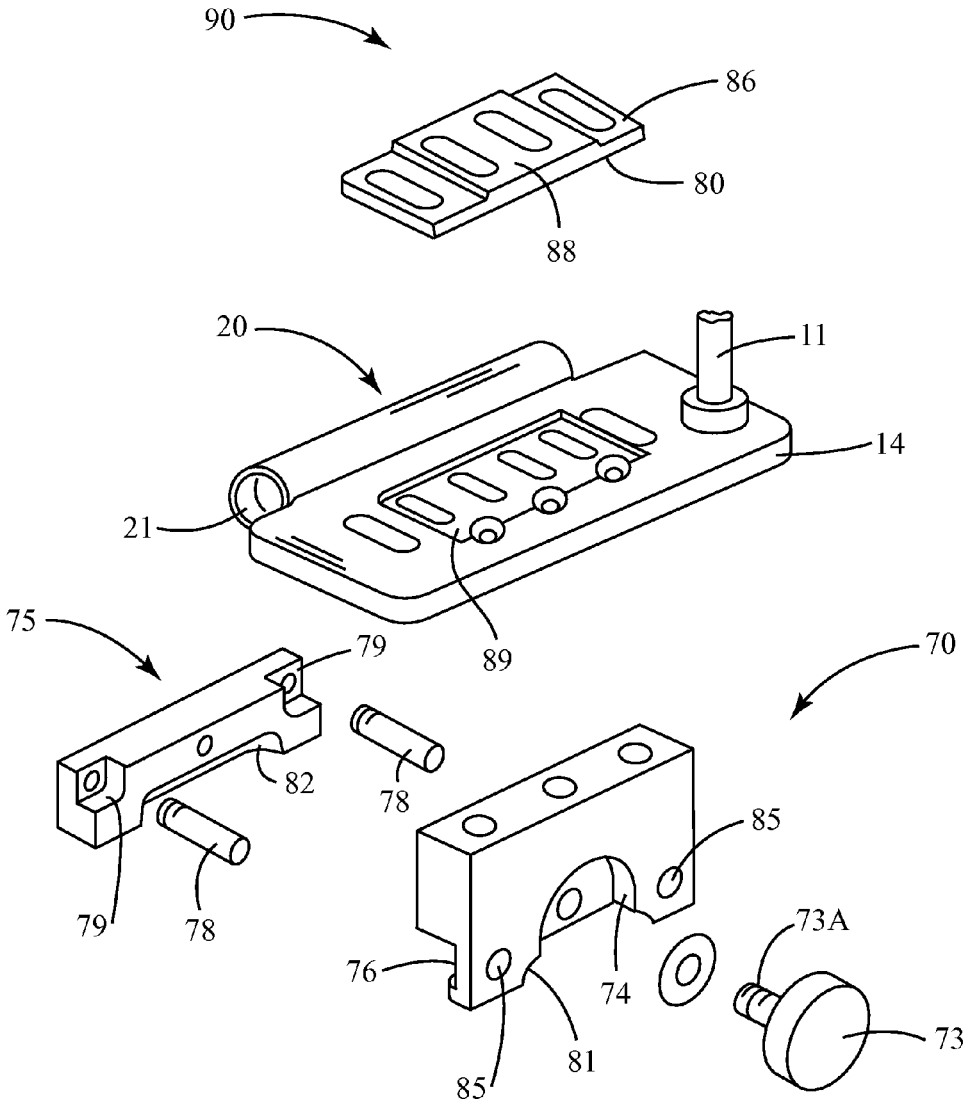
FIG. 6 shows exploded three quarter views of the improved Global-tuner arrangement and the separate multi-tiered insert plate improvement shown with slots, for example, formed to cooperate with intonation slots in the base plate; also is shown in the recess countersunk in the base plate formed to receive the insert plate for selective adjustment of the second critical point relative to the base plate.

In FIG. 2 and FIG. 6 separate multi-tiered insert plate 90 is shown positioned between base plate 14 and one of a plurality of individual intonation modules 12 for use on an otherwise conventional six-string guitar with a fulcrum tremolo. Insert plate 90 comprises a generally flat or planar underside 80 to be positioned on a conventional base plate 14 comprising a suitably flat or planar surface to receive intonation modules or similar. Insert plate 90 further comprises first tier 86 with a first dimension from plate underside 80 and second tier 88 with a second dimension from plate underside 80 to vary displacement of an individual intonation point 16 on intonation module relative to body 3 (shown on FIG. 2 only). In the preferred embodiment shown, insert plate 90 comprises first tier 86 flanking each side of second tier 88 wherein first tier 86 is positioned to displace each bridge element 42 associated to strings 2 and 5 by the first dimension and to displace each bridge element 42 associated to strings 3 and 4 by the second dimension; for example, first tier 86 could have a first dimension of 0.029 and second tier 88 could have a dimension of 0.044 to comprise a 12" radius where the outer strings 1 and 6 have no displacement. The insert plate can include other openings and/or recesses to facilitate string holes and other means of adjusting the harmonic tuning for any bridge element 42. Base plate 14 is further fashioned with insert recess 89 to receive insert plate 90 in part. For example, insert recess 89 could have a countersunk depth of 0.015" and insert plate 90 compensated so first and second tiers at 0.044" and 0.059" still provide the 12" radius; in this instance (three) screws 72 for (shown in FIGS. 2 and 4) connecting the separate transverse element 71 or spring block through base plate 14 would be further countersunk to allow the unrestricted positioning of insert plate 90.

The invention claimed is:

1. An apparatus for a stringed musical instrument comprising a body and a neck, a plurality of strings extending from the body to the neck, a nut for supporting the strings on the neck forming a first critical point for each string, a bridge element forming a second critical point for supporting each of the strings on the body, the apparatus located on the body on the opposite side of the bridge element from the nut; the apparatus further comprising:

an enclosed clamping device for a string, the enclosed clamping device being disposed within a clamp housing element, wherein the clamp housing element comprising a centerline, the centerline further extending in the direction of the strings, the clamp housing element further comprising a housing axis, wherein the housing axis transverse the direction of the strings, the housing axis being disposed in a fixed position, the enclosed clamping device further comprising enclosed clamping elements, each of the enclosed clamping elements comprising:

a forward end, the forward end closer the nut, the forward end comprising an enlarged opening, the enlarged opening forming internal surfaces, the internal surfaces within the clamp housing element, the internal surfaces further comprising an upper surface and a lower surface, the upper surface further the body, the lower surface closer the body;

a separate paddle-like lever element, the separate paddle-like lever element comprising a first end, a second end and a middle portion, the first end furthest the nut, the first end comprising a hinge-like pivot portion, the hinge-like pivot portion having a singular axis, the separate paddle-like lever pivotally connected to the clamp housing element on the housing axis, the middle portion and second end combination further comprising a blade-like portion, the blade-like portion comprising a first surface and a second surface, the first surface extending in the direction of the strings closer the upper surface, the second surface extending in the direction of the strings closer the lower surface;

a clamping element, the clamping element threadedly connected to the clamp housing element, variably connected to the first surface operable to pivot the separate paddle-like lever element, wherein threading the clamping element is operable to position the separate paddle-like lever element within the clamp housing element to secure the string between the lower surface and the second surface.

2. An apparatus of claim 1 further comprises a tuning element, the tuning element comprises a base element, the base element formed to slideably receive the clamp housing element operable to tension a string, the base element further comprising base element limiting inner walls, the base element limiting inner walls essentially parallel to the centerline, the clamp housing element formed with outer limiting walls, the outer limiting walls essentially parallel the centerline, the clamp housing element formed to receive a string therethrough, the clamp housing element further comprising a threaded rearward end, the threaded rearward end further the nut, a tuner adjustment knob connected to the threaded rearward end, turning the tuner adjustment knob operable to slideably position the clamp housing element to macro-tune a string, wherein the base element limiting inner walls cooperate with the clamp housing element outer limiting walls to impede the rotation of the enclosed clamping device when turning the tuner adjustment knob to macro-tune a string.

3. An apparatus for a fulcrum tremolo mounted on the body of a stringed musical instrument for pivotally supporting strings, the fulcrum tremolo further comprising:

a base plate comprising a first side furthest the body further comprising the bridge element and a second side closer the body, a transverse element connected to the second side, the transverse element comprising a biasing end furthest the base plate connected to a first end of the biasing element, the second end of the biasing element connected to the body, the apparatus comprising:

at least one biasing element holder, a stabilizing element, the stabilizing element connected to the transverse element on one end and to the biasing element holder on the other end to impede the rotation of the biasing element holder, the transverse element, and a singular apparatus directly connected to the biasing element holder and to the transverse element, the singular apparatus further comprising:

a thumbwheel element, the thumbwheel element rotatably connected through the transverse element and through the at least one biasing element holder and operable to position the at least one biasing element holder to alter the bias applied by the biasing element, the thumbwheel element further comprising:

a thumbwheel portion, and an elongated threaded portion, wherein at least a portion of at least one element of the apparatus comprising the group: the transverse element, the biasing element holder, the stabilizing element, further comprises a first separate recess.

4. The apparatus of claim 3, wherein the first separate recess of the transverse element further comprises a first manual access to the thumbwheel.

5. The apparatus of claim 3, wherein the at least one biasing element holder further comprises a second separate recess, the second separate recess comprises a second manual access to the thumbwheel.

6. The apparatus of claim 3, the stabilizing element further comprises at least one elongated element extending at least from the at least one biasing element holder to the transverse element.

7. Apparatus of claim 3, the stabilizing element further comprises at least one spring element extending at least between the at least one biasing element holder and the transverse element to urge the at least one biasing element to a position away from the transverse element.

8. Apparatus of claim 3, the stabilizing element further comprises at least one U-shaped spring extending between the at least one biasing element holder and the transverse element to impede rotation of the at least one biasing element holder and urge the at least one biasing element in a direction away from the transverse element.

9. Apparatus of claim 3, wherein the transverse element further comprises at least one other first separate recess to receive at least a portion of a stabilizing element.

10. Apparatus of claim 3, wherein the at least one biasing element holder further comprises at least one other second separate recess to receive at least a portion of a stabilizing element.

11. An integrated riser post for a bearing arrangement to pivotally support a fulcrum tremolo on a stringed musical instrument comprising a body, a neck extending outwardly from the body, a plurality of strings extending in a direction from the body to the neck, a nut to form a first critical point for each of the strings, the fulcrum tremolo further comprising:

a pivot axis;

a bearing arrangement transverse the direction of the strings to adjustably mount the fulcrum tremolo to the body, the bearing arrangement comprising:

a bearing element, a bearing axle element aligned to the pivot axis, the bearing axel comprising an enlarged first end, a bearing housing portion for receiving a bearing element, the integrated riser post comprising:

a threaded portion transverse the bearing axel element to position the fulcrum tremolo relative to the body, and a bearing axle housing portion, the bearing axel housing portion further comprising a smooth bore portion aligned to the pivot axis for receiving the bearing axle enlarged first end, wherein the improvement comprises a slotted access to the smooth bore portion in the integrated riser post extending in the direction of the axis to position the bearing axel within the opening from a direction transverse the axis of the bearing axle.

12. Apparatus of claim 11, wherein the slotted access comprises a first dimension wherein the enlarged first end is proportionally larger than the first dimension of the slotted access.

13. Apparatus of claim 12, the slotted access in the axel opening further comprises a second dimension in the opening extending in the direction of the axis to allow the enlarged first end of the bearing axel element to be positioned within the smooth bore portion from a direction transverse the axis of the bearing axle element.

14. An integrated riser post threadably connected to a stringed musical instrument comprising a body, a neck extending outwardly from the body, a plurality of strings extending in a direction from the body to the neck, a nut to form a first critical point for each of the strings, a fulcrum tremolo, to adjustably support a bearing arrangement operable for pivoting the fulcrum tremolo relative to the instrument body, the fulcrum tremolo further comprising:

a pivot axis a bearing arrangement transverse the direction of the strings to adjustably mount the fulcrum tremolo to the body, the bearing arrangement comprising:

a bearing element, a bearing axle element aligned to the pivot axis, a bearing housing portion for receiving a bearing element, the integrated riser post further comprising:

a bearing axle housing portion, a threaded portion transverse the bearing axel element the threaded portion further comprises a separate outer threaded sleeve element, an inner cylindrical portion transverse the bearing axle element, wherein the inner cylindrical portion is rotatably separate outer threaded sleeve element operable to align the bearing housing portion to the bearing axle element.

15. Apparatus of claim 14, the inner cylindrical portion of the integrated riser post further comprises:

a threaded opening opposite the bearing housing portion, threadably connected to an attachment screw, the attachment screw further comprises:

a threaded portion, a head dimensioned with a diameter greater than the diameter of the inner cylindrical portion and less than the diameter of the separate outer threaded sleeve element, wherein threading the attachment screw in one direction is operable to fixedly secure the separate outer threaded sleeve element to the cylindrical portion.

16. Apparatus of claim 15, the integrated riser post further comprises a compression element positioned between the head and the separate outer threaded sleeve element, wherein threading the attachment screw is operable to engage the compression element to further fixedly secure the separate outer threaded sleeve element to the inner cylindrical portion.

17. Apparatus of claim 15, the integrated riser post further comprises an access hole extending through the bearing housing portion and the inner cylindrical portion, the attachment screw further comprising a recess at the end of the threaded portion aligned to the access hole, wherein inserting an adjustment tool through the access hole to engage the recess of the attachment screw is operable to thread the attachment screw in one direction to fixedly secure the separate outer threaded sleeve element to the inner cylindrical portion.

18. Apparatus of claim 15, the integrated riser post further comprising:

a bearing axle housing portion of the integrated riser post further comprises a slotted access extending in the direction of the axis to allow the bearing axel element to be positioned within the opening from a direction transverse the axis of the bearing axle element.

19. An apparatus for a stringed musical instrument comprising a body and a neck, a plurality of strings extending from the body to the neck, a nut for supporting the strings on the neck forming a first critical point for each string, a bridge element forming a second critical point for supporting each of the strings on the body and a first tailpiece to secure a string to the body wherein the apparatus comprises a fulcrum tremolo for pivotally supporting the strings further comprising a base plate, the base plate further comprising an unitary component that is a single piece of bent material, a second tailpiece, a string clamping device for a string, positioned between the first tailpiece and the bridge element, the clamping element further comprising:

a forward end closer the nut, and a rearward end further the nut;

an enlarged recess formed to receive a string therethrough, the enlarged recess;

a clamping portion variably connected to the string clamping element comprising a first surface and a radiused second surface; and a clamping element variably connected to the string clamping device in varand the first surface of the clamping portion;

wherein adjusting the clamping element is operatable to position the radiused second surface of the clamping portion to secure a string and render the string inextensible between the first and second tailpiece;

wherein the second tailpiece comprises an elongated portion connected to the string clamping device extending in a direction opposite to the nut; the elongated portion further comprises a hollow tube fashioned to receive a string therethrough, the hollow tube comprising a:

first end closer the string clamping element; and second end located further the string clamping device, wherein the second end comprises the second tailpiece;

wherein the enlarged recess comprises an upper surface further the body extending in the direction of the strings and a lower surface closer the body extending in the direction of the strings, the first surface of the clamping portion extending in the direction of the strings closer the upper surface, the second radiused surface of the clamping portion extending in the direction of the strings closer the lower surface, the clamping element transverse the direction of the strings wherein adjusting the clamping element secures a string between the lower surface and the radiused second surface at a point comprising a second tailpiece; the enlarged recess further comprises an additional opening extending through the first side;

clamping portion further comprises an L-shaped form, comprising:

an upper leg, the upper leg extending away from the lower leg transverse the direction of the string through the additional opening;

a lower leg, the lower leg comprising the first and second surface;

wherein the upper portion is operatable to manipulate the position of the clamping portion;

wherein the fulcrum tremolo further comprises an intonation module for at least one string, the intonation module further comprising a base connected to the stringed musical instrument, the base further comprising either:

a macro-tuner on the opposite side of the bridge element from the nut to tension a string, the macro-tuner further comprising:

a tuner pin slideably connected to the base located on the opposite side of the bridge portion from the nut and extending in a direction opposite to the nut, the tuning pin further comprising a slotted forward end closer the nut, a threaded rearward end further the nut comprising the first tailpiece, a tuner adjustment knob threadedly connected to the second end of tuner pin;

wherein threading the tuner adjustment knob is operable to slideably position the tuning element to macro-tune a string;

or a fine-tuner on the opposite side of the bridge element from the nut to adjust tension in a string, the fine-tuner further comprising:

a tuning element variably connected to the base, the fine-tuner element further comprising:

a threaded elongated portion rearward end further the nut, and a tuner adjustment knob threadedly connected to the elongated portion;

wherein threading the tuner adjustment knob is operable adjust tension in a string;

the fulcrum tremolo further comprising a pivot axis and at least one additional portion connected to the base plate formed to receive at least a portion of at least one bearing assembly; the at least one bearing assembly, comprising:

at least a portion of a shaft aligned to the pivot axis, at least one mounting element comprising a shaped recess, at least a portion of a ball bearing surface wherein the mounting element comprises a bearing housing and a housing for the at least a portion of a shaft;

and the base plate further comprising a first side furthest the body further comprising the bridge element and a second side closer the body, a transverse element connected to the second side, the transverse element comprising a biasing end furthest the base plate connected to a first end of biasing element, the second end of biasing element connected to the body, the apparatus further comprising:

at least one biasing element holder connected to the transverse element, a stabilizing element, the stabilizing element connected to the transverse element on one end and to the biasing element holder on the other end to impede the rotation of the biasing element holder, and a singular apparatus directly connected to the biasing element holder and to the transverse element, the singular apparatus further comprising:

a thumbwheel element, the thumbwheel element rotatably connected through the transverse element and through the at least one biasing element holder and operable to position the at least one biasing element holder to alter the bias applied by the biasing element, the thumbwheel element further comprising:

a thumbwheel portion, and an elongated threaded portion, wherein at least a portion of at least one element of the apparatus comprising the group: the transverse element, the biasing element holder, the stabilizing element, further comprises a first recess;

wherein the first separate recess of the transverse element further comprises a first manual access to the thumbwheel;

wherein the at least one biasing element holder further comprises a second separate recess, the second separate recess comprises a second manual access to the thumbwheel;

wherein the stabilizing element further comprises at least one elongated element extending at least from the at least one biasing element holder to the transverse element;

wherein the stabilizing element further comprises at least one spring element extending at least between the at least one biasing element holder and the transverse element to urge the at least one biasing element to a position away from the transverse element;

and the fulcrum tremolo further comprising:

an integrated riser post for the bearing arrangement to pivotally support the fulcrum tremolo on the pivot axis, a bearing arrangement transverse the direction of the strings to adjustably mount the fulcrum tremolo to the body, the bearing arrangement comprising:

a bearing element;

the at least a portion of a shaft further comprising a bearing axle element aligned to the pivot axis, a bearing housing portion for receiving a bearing element, the integrated riser post comprising:

a threaded portion transverse the bearing axel element to position the fulcrum tremolo relative to the body, and a bearing axle housing portion, the bearing axel housing portion further comprising an opening aligned to the pivot axis for receiving the bearing axle element, wherein the integrated riser post opening further comprises a slotted access extending in the direction of the axis to position the bearing axel within the opening from a direction transverse the axis of the bearing axle element;

wherein the bearing axel element further comprises an enlarged first end proportionally larger than the first dimension of the slotted access;

wherein the slotted access in the axel opening further comprises a second dimension in the opening extending in the direction of the axis to allow the enlarged first end of the bearing axel element to be positioned within the opening from a direction transverse the axis of the bearing axle element, the integrated riser post further comprising:

a bearing axle housing portion, a threaded portion transverse the bearing axel element to position the bearing arrangement and, thereby, the fulcrum tremolo relative to the body, the threaded portion of the integrated riser post further comprises a separate outer threaded sleeve element, and an inner cylindrical portion transverse the bearing axle element aligned to the threaded portion, wherein the inner cylindrical portion is rotatably connected to the separate outer threaded sleeve element operable to align the bearing housing portion to the bearing axle element;

wherein the inner cylindrical portion of the integrated riser post further comprises a threaded opening opposite the bearing housing portion, threadably connected to an attachment screw, the attachment screw further comprises:

a threaded portion, a head dimensioned with a diameter greater than the diameter of the inner cylindrical portion and less than the diameter of the separate outer threaded sleeve element, wherein threading the attachment screw in one direction is operable to fixedly secure the separate outer threaded sleeve element to the cylindrical portion wherein the integrated riser post further comprises a compression element positioned between the head and the separate outer threaded sleeve element, wherein threading the attachment screw is operable to engage the compression element to further fixedly secure the separate outer threaded sleeve element to the inner cylindrical portion;

wherein the integrated riser post further comprises an access hole extending through the bearing housing portion and the inner cylindrical portion, the attachment screw further comprising a recess at the end of the threaded portion aligned to the access hole, wherein inserting an adjustment tool through the access hole to engage the recess of the attachment screw is operable to thread the attachment screw in one direction to fixedly secure the separate outer threaded sleeve element to the inner cylindrical portion;

wherein the integrated riser post further comprising:

a bearing axle housing portion of the integrated riser post further comprises a slotted access extending in the direction of the axis to allow the bearing axel element to be positioned within the opening from a direction transverse the axis of the bearing axle element and a separate apparatus, comprising a singular insert plate positioned between the body and second critical points, the insert plate further comprising at least one first tier for supporting a first of at least two second critical points and at least one second tier for supporting a second of at least two second critical points, the at least one first tier having a first surface closer the body for displacing the first of at least two second critical points by a first dimension and the at least one second tier having a surface further the body for displacing the second of at least two second critical points by a second dimension, wherein the insert plate displaces each position of the at least two second critical points relative to the body;

wherein the base plate comprises a countersunk recess to receive at least a portion of the singular insert plate.

20. An apparatus for a fulcrum tremolo mounted on the body of a stringed musical instrument for pivotally supporting strings, the stringed musical instrument further comprising a body, a neck extending outwardly from the body, a plurality of strings extending in a direction from the body to the neck, a nut on the opposite end of the neck from the body forming a first critical point for each of the strings, a bridge element to support the strings over the body forming the second critical point for each of the strings, the fulcrum tremolo comprising a base plate, the apparatus comprising a base element, the base element slideably connected to the base plate operable to adjust harmonic tuning, the base element further comprising the bridge element, a clamp housing element, an enclosed clamping mechanism for a string, the enclosed clamping mechanism disposed within the clamp housing element, the clamp housing element further comprising a housing axis, the housing axis transverse the direction of the strings, the housing axis in a fixed position, the clamp housing element further comprising a string tensioning element, the string tensioning element slideably connected to the base element operable to tension a string:

the string tensioning element having a hollow cylindrical-like element, the cylindrical-like element extending in the direction of the strings, the hollow cylindrical-like element formed to receive a string therethrough, and a threaded rearward end, the threaded rearward end further the nut, the clamp housing element further comprising:

a forward end, the forward end closer the nut, the forward end comprising an enlarged opening, the enlarged opening further forming internal surfaces, the internal surfaces formed within the clamp housing element, the internal surfaces comprising an upper surface and a lower surface, the upper surface further the body, the lower surface closer the body, a separate paddle-like lever element, the separate paddle-like lever element comprising at least one end, one end of the at least one end further comprising a hinge-like pivot portion, the hinge-like pivot portion having a singular axis, the separate paddle-like lever element pivotally connected to the housing axis, the separate paddle-like lever element comprising a lever centerline, the lever centerline of the separate paddle-like lever element extending generally in the direction of the strings, the separate paddle-like lever element further comprising a blade-like portion, the bladelike portion comprising a first surface and a second surface, the first surface extending in the direction of the strings closer the upper surface, the second surface extending in the direction of the strings closer the lower surface, a clamping element, the clamping element threadedly connected to the upper surface, the clamping element variably connected to the first surface of the blade-like portion, threading the clamping element operatable to pivot the separate paddle-like lever element within the clamp housing element, wherein the tuning element further comprising a tuner adjustment knob connected to the threaded rearward end of the enclosed clamping mechanism, the tuner adjustment knob operable to slideably position the tuning element to macro-tune a string.

21. A tuning element for a stringed musical instrument, the stringed musical instrument further comprising a body, a neck extending outwardly from the body, a plurality of strings extending in a direction from the body to the neck, a nut on the opposite end of the neck from the body forming a first critical point for each of the strings, a bridge element to support the strings over the body forming the second critical point for each of the strings, the bridge element further comprising a base element, the tuning element slideably connected to the base element operable to tension a string, the base element slideably connected to the body operable to adjust harmonic tuning, the tuning element having a hollow cylindrical-like element, the hollow cylindrical-like element extending in the direction of the strings, the hollow cylindrical-like element having limited confines, the limited confines limited to a maximum cross-section dimension, the maximum cross-section dimension perpendicular to the centerline, the tuning element further comprises a tuner adjustment knob, the tuner adjustment knob threadedly connected to the tuning element, the tuning element further formed to receive a string therethrough, the tuning element further comprising an enclosed clamping mechanism, the enclosed clamping mechanism disposed within a clamp housing element, the clamp housing element comprising a housing axis, the housing axis transverse the direction of the strings, the housing axis disposed in a fixed position, the enclosed clamping mechanism further comprises:

a forward end, the forward end closer the nut, the forward end comprising an enlarged opening, the enlarged opening further comprising internal surfaces, the internal surfaces formed within the clamp housing element, the internal surfaces comprising an upper surface and a lower surface, the upper surface further the body, the lower surface closer the body, a separate paddle-like lever element, the separate paddle-like lever element pivotally aligned to the housing axis, the separate paddle-like lever element operable to secure a string to the musical instrument, the separate paddle-like lever element comprising:

a first surface and a second surface, the first surface of the separate lever element extending in the direction of the strings closer the upper surface, the second surface extending in the direction of the strings closer the lower surface, a clamping element, the clamping element threadedly connected to the tuning element, variably connected to the first surface, threading the clamping element operatable to pivot the separate paddle-like lever element on the housing axis to secure the string, wherein the clamping element and the separate paddle-like lever element are operable within the limited confines of the cylindrical-like element of tuning element.

22. An apparatus for a stringed musical instrument comprising a body and a neck, a plurality of strings extending from the body to the neck, a nut for supporting the strings on the neck forming a first critical point for each string, a bridge element forming a second critical point for supporting each of the strings on the body and a tailpiece to secure a string to the body wherein the apparatus comprises a string clamping device for a string, positioned between the tailpiece and the bridge element, the string clamping device disposed within a clamp housing element, the clamp housing element further comprising a housing axis, the housing axis transverse the direction of the strings, the housing axis disposed in a fixed position, the string clamping device further comprising:

a forward end closer the nut, a rearward end further the nut, the clamp housing element further comprising a hollow cylindrical-like element, the hollow cylindrical-like element extending in the direction of the strings, the hollow cylindrical-like element formed to receive a string therethrough, the hollow cylindrical-like element further formed to comprise an enlarged opening, the enlarged opening closer the nut, the enlarged opening further forming internal surfaces, the internal surfaces further comprising an upper surface and a lower surface, the upper surface further the body, the lower surface closer the body, a separate paddle-like element, the separate paddle-like element further comprising:

a first end, the first end furthest the nut, the first end further comprising a hinge-like pivot portion, the hinge-like pivot portion having a singular axis, separate paddle-like clamping element pivotally connected to the housing axis, a blade-like portion, the blade-like portion comprising a first surface and a second surface, the second surface operable to variably contact the string, a clamping element, the clamping element transverse the direction of the strings, the clamping element threadedly connected to the upper surface and variably connected to the first surface, wherein threading the clamping element is operatable to pivot the separate paddle-like element about the housing axis to secure a string.

* * * * *